US011196205B2

(12) United States Patent
Toda et al.

(10) Patent No.: US 11,196,205 B2
(45) Date of Patent: Dec. 7, 2021

(54) CONNECTION STRUCTURE, FORMING METHOD OF CONNECTION STRUCTURE AND CABLE OF CONNECTION STRUCTURE

(71) Applicant: JAPAN AVIATION ELECTRONICS INDUSTRY, LIMITED, Tokyo (JP)

(72) Inventors: Kentaro Toda, Tokyo (JP); Yoshihiro Sugii, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/907,353

(22) Filed: Jun. 22, 2020

(65) Prior Publication Data

US 2021/0021073 A1 Jan. 21, 2021

(30) Foreign Application Priority Data

Jul. 16, 2019 (JP) ..... JP2019-131187

(51) Int. Cl.
*H01R 13/426* (2006.01)
*H01R 43/20* (2006.01)
(Continued)

(52) U.S. Cl.
CPC ..... *H01R 13/426* (2013.01); *H01R 13/506* (2013.01); *H01R 13/516* (2013.01); *H01R 43/20* (2013.01)

(58) Field of Classification Search
None
See application file for complete search history.

(56) References Cited

U.S. PATENT DOCUMENTS 3,177,464 A * 4/1965 Solorow ..... H01R 13/4367 439/695
7,172,467 B1 * 2/2007 Yohn ..... H01R 13/426 439/686

(Continued)

FOREIGN PATENT DOCUMENTS

CN 101404191 A 4/2009
CN 103187636 A 7/2013

(Continued)

OTHER PUBLICATIONS

Chinese Office Action (and English language translation thereof) dated Aug. 13, 2021, issued in counterpart Chinese Application No. 202010601854.0.

*Primary Examiner* — Oscar C Jimenez
(74) *Attorney, Agent, or Firm* — Holtz, Holtz & Volek PC

(57) ABSTRACT

A connection structure comprises a cable and a connection object. The cable includes two wires and an insulation body which covers and binds the two wires. The insulation body includes two coverings which cover the wires, respectively. The connection object comprises a base portion and a pressing member. The base portion has a catch portion and a cable-holding portion. The cable has a held section and a pressed section. The held section is held by the cable-holding portion. The pressed section is sandwiched and pressed between the pressing member and the catch portion in an upper-lower direction (Z-direction). The insulation body of the pressed section includes a coupling strip. The coupling strip couples the two coverings to each other in a lateral direction (Y-direction).

9 Claims, 9 Drawing Sheets

(51) Int. Cl.
*H01R 13/506* (2006.01)
*H01R 13/516* (2006.01)

(56) References Cited

U.S. PATENT DOCUMENTS

| | | | | |
|---|---|---|---|---|
| 9,035,183 | B2 | 5/2015 | Kodama et al. | |
| 9,653,843 | B2 * | 5/2017 | Suzuki | H01R 13/58 |
| 10,381,786 | B2 * | 8/2019 | Nakamura | H01R 13/6593 |
| 10,454,197 | B1 * | 10/2019 | Ruffini | H01R 13/426 |
| 2006/0035513 | A1 * | 2/2006 | Yohn | H01R 13/6592 439/460 |
| 2014/0102783 | A1 | 4/2014 | Nagahashi | |

FOREIGN PATENT DOCUMENTS

| | | | |
|---|---|---|---|
| CN | 103548098 | A | 1/2014 |
| CN | 206774268 | U | 12/2017 |
| JP | H09259651 | A | 10/1997 |
| JP | H11224540 | A | 8/1999 |
| JP | 2002042564 | A | 2/2002 |
| JP | 2003338228 | A | 11/2003 |
| TW | 201709013 | A | 3/2017 |

* cited by examiner

CONNECTION STRUCTURE, FORMING METHOD OF CONNECTION STRUCTURE AND CABLE OF CONNECTION STRUCTURE

CROSS REFERENCE TO RELATED APPLICATIONS

This application is based on and claims priority under 35 U.S.C. § 119 to Japanese Patent Application No. JP 2019-131187 filed Jul. 16, 2019, the content of which is incorporated herein in its entirety by reference.

BACKGROUND OF THE INVENTION

This invention relates to a connection structure comprising a cable and a connection object.

For example, JPH11-224540A (Patent Document 1) discloses a cable configured to be connected to a connection object such as a switchboard, the contents of which is incorporated herein by reference.

Referring to FIG. 16, a cable 90 disclosed in Patent Document 1 includes two electric cords 92 and a sheath (insulation body) 94 which covers and binds the two electric cords 92. Each of the electric cords 92 includes a wire 922 and an insulation covering 924 which covers the wire 922. The cable 90 is formed with two gaps 96 located between the two electric cords 92. According to Patent Document 1, when the cable 90 is connected to a connection object, a cutter 98 separates the two electric cords 92 individually from each other.

According to Patent Document 1, when a connection object is connected to a cable in which two electric cords (wires) are bound, the wires need to be individually separated from each other. However, it is cumbersome to arrange the thus-separated two wires with a required distance therebetween.

SUMMARY OF THE INVENTION

It is therefore an object of the present invention to provide a connection structure which allows two wires thereof to be apart from each other by a required distance and enables the required distance between the wires to be kept.

An aspect of the present invention provides a connection structure comprising a cable and a connection object. The cable includes two wires and an insulation body which covers and binds the two wires. The insulation body includes two coverings. The coverings cover the wires, respectively. The connection object comprises a base portion and a pressing member. The base portion has an attachment surface, a catch portion, two pads and a cable-holding portion. The pads correspond to the wires, respectively. The catch portion is provided on the attachment surface. Each of the pads is provided on the attachment surface and is located forward of the catch portion in a front-rear direction. The cable-holding portion is located rearward of the catch portion. The pressing member is attached to the base portion and is located forward of the cable-holding portion. The cable has a held section and a pressed section. The held section is held by the cable-holding portion. The insulation body of the held section includes a ridge and is formed with a partition groove. The ridge and the partition groove are located between the two coverings in a lateral direction perpendicular to the front-rear direction and are located at positions opposite to each other in an upper-lower direction perpendicular to both the front-rear direction and the lateral direction. The ridge projects along a projecting direction directed upward or downward. The partition groove is depressed along the projecting direction. The pressed section is sandwiched and pressed between the pressing member and the catch portion in the upper-lower direction. The insulation body of the pressed section includes a coupling strip. The coupling strip couples the two coverings to each other in the lateral direction. The coupling strip includes a middle ridge and is formed with a middle groove. The middle ridge and the middle groove are located at positions opposite to each other in the upper-lower direction. The middle ridge projects along the projecting direction. The middle groove is depressed along the projecting direction. The middle ridge of the pressed section is in contact with one of the pressing member and the catch portion, and the two coverings of the pressed section are in contact with at least a remaining one of the pressing member and the catch portion. Each of the wires has an exposed portion exposed from the covering. Each of the exposed portions is connected to a corresponding one of the pads. In the lateral direction, a distance between the two wires of the pressed section is longer than another distance between the two wires of the held section.

As can be seen from the structure of the held section of the cable according to the present invention, the insulation body of the cable includes the ridge and the partition groove in addition to the two coverings before the cable is connected to the connection object. The thus-formed cable can be elastically deformed as described below. First, a wall of the partition groove of the cable, which extends along the front-rear direction, is partially formed with an incision extending along the front-rear direction. Then, the cable is arranged so that the ridge projects upward or downward. Then, the pressing member is attached to the base portion, and the pressed section of the cable formed with the incision is sandwiched and pressed between the pressing member and the catch portion in the upper-lower direction. The ridge of the thus-sandwiched pressed section is elastically deformed to be spread in the lateral direction, so that the coupling strip is formed. Meanwhile, the two coverings are moved to be away from each other in the lateral direction while being coupled to each other by the coupling strip.

According to an aspect of the present invention as described above, only by forming the partial incision in the cable and by vertically sandwiching and pressing the cable, the two wires can be apart from each other by a required distance without being individually separated from each other. In addition, the two wires can be kept apart from each other by the required distance. Thus, an aspect of the present invention provides a connection structure which allows two wires thereof to be apart from each other by a required distance and enables the required distance between the wires to be kept.

An appreciation of the objectives of the present invention and a more complete understanding of its structure may be had by studying the following description of the preferred embodiment and by referring to the accompanying drawings.

Figure 1:
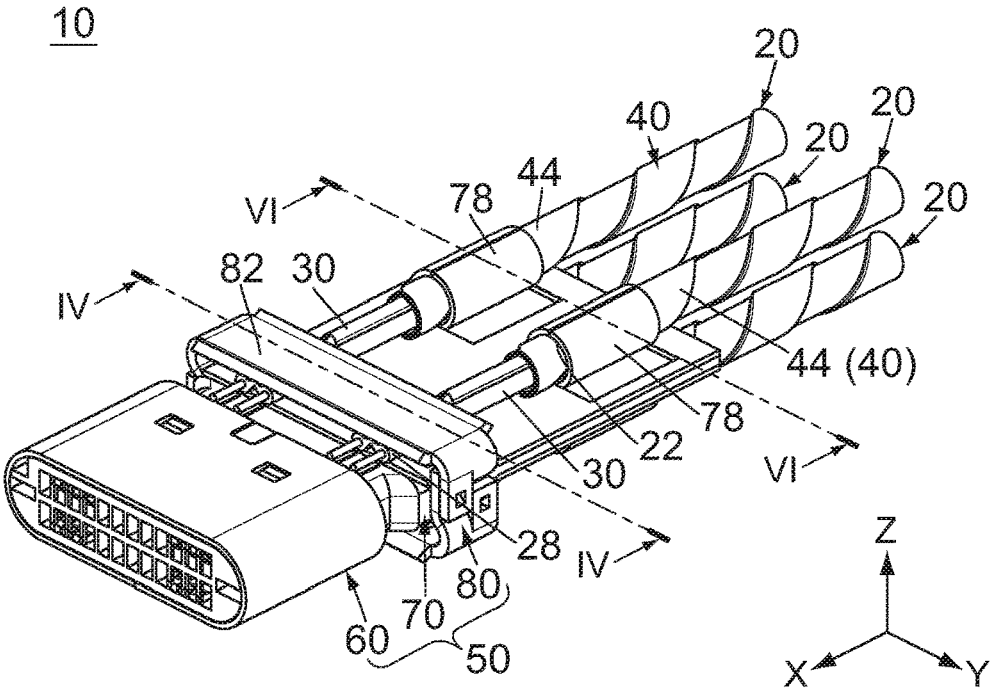
FIG. 1 is a perspective view showing a connection structure according to an embodiment of the present invention, wherein cables of the connection structure are connected to a connection object of the connection structure.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
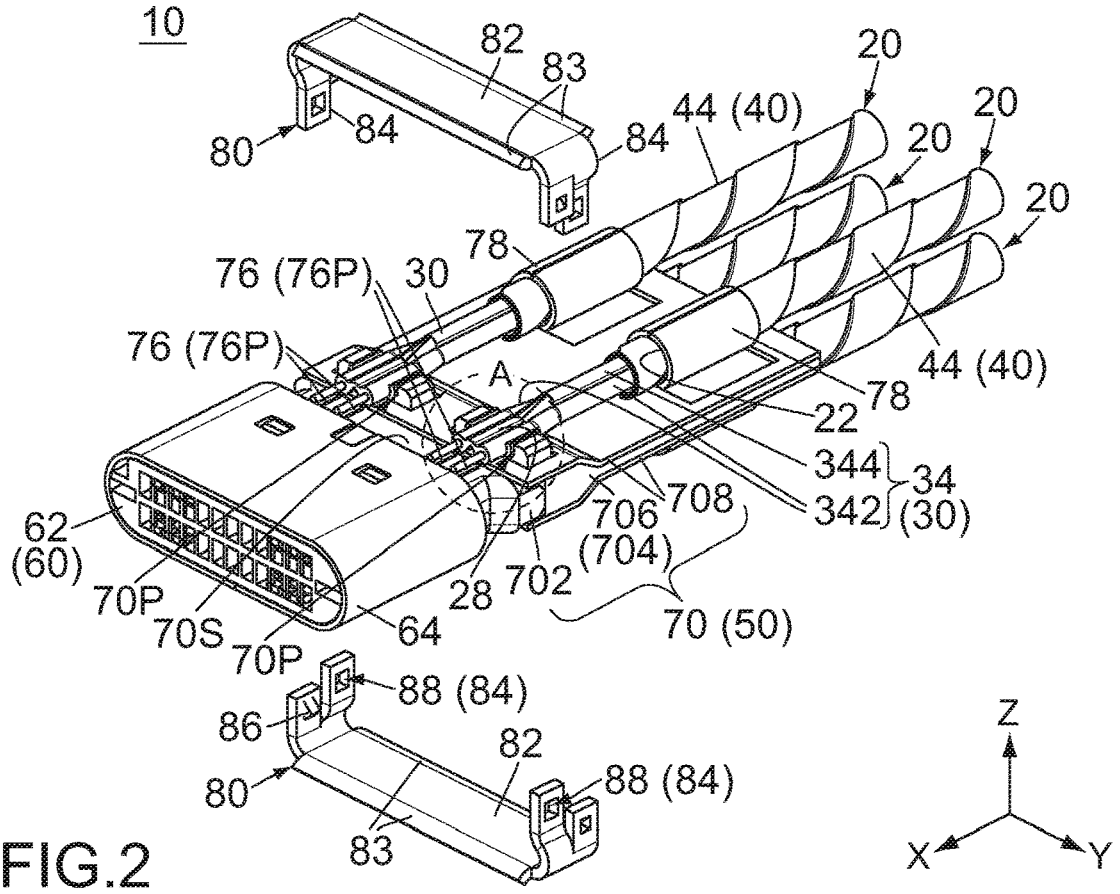
FIG. 2 is a perspective view showing the connection structure of FIG. 1 under a state where pressure members of the connection object are detached.

As shown in FIGS. 1 and 2, a connection structure 10 according to an embodiment of the present invention comprises four cables 20 and a connection object 50. The cables 20 have structures same as one another and are connected to the connection object 50 in the same way as one another. However, the present invention is not limited thereto. For example, the cables 20 may have structures different from one another. Moreover, the number of the cables 20 of the connection structure 10 may be one or more.

Hereafter, explanation will be made about the structure of one of the cables 20. The following explanation is applicable to each of the cables 20 according to the present embodiment.

The cable 20 of the present embodiment includes an inner member 30 and an outer member 40. The inner member 30 is an inner structure of the cable 20 and extends along a predetermined direction that is an extending direction of the cable 20. The outer member 40 covers the inner member 30 in a cable cross-section perpendicular to the predetermined direction. The inner member 30 has an end that is exposed from the outer member 40.

The outer member 40 of the present embodiment is a tape 44 wounded around the inner member 30. The tape 44 comprises two layers, namely a shielding layer (not shown) made of metal and an insulating layer (not shown). However, the present invention is not limited thereto, but the structure of the outer member 40 can be modified variously as necessary.

Figure 3:
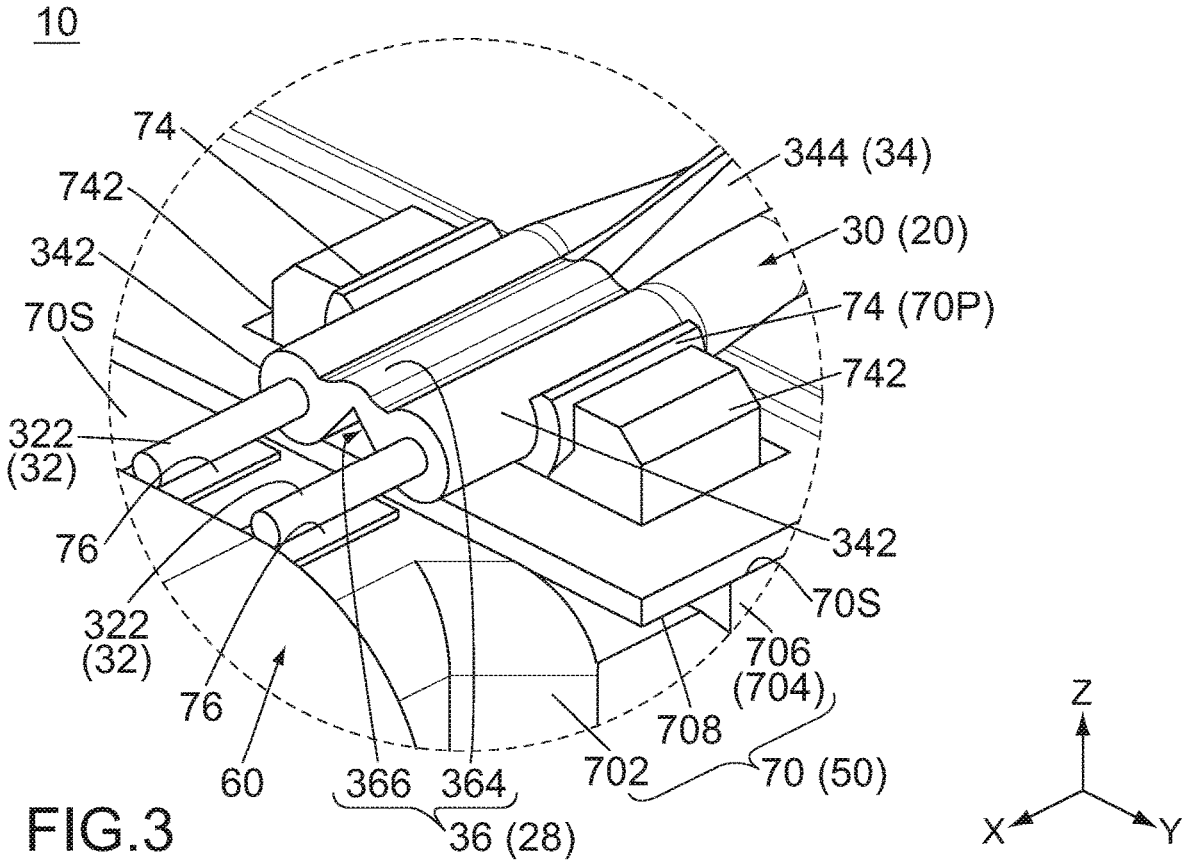
FIG. 3 is a perspective view showing a part of the connection structure of FIG. 2 enclosed by dashed line A.
Figure 5:
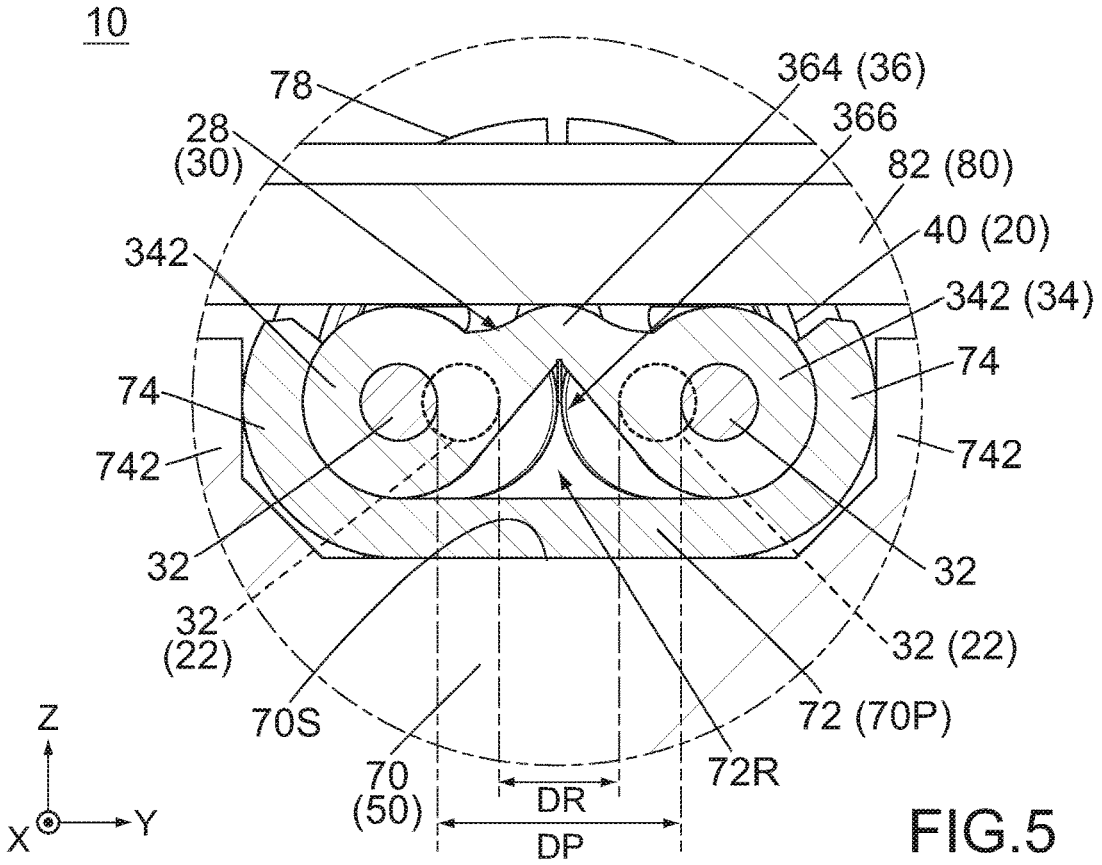
FIG. 5 is a cross-sectional view showing a part of the connection structure of FIG. 4 enclosed by chain dotted lines B, wherein positions of wires of a held section of the cable are illustrated with dashed line.
Figure 6:
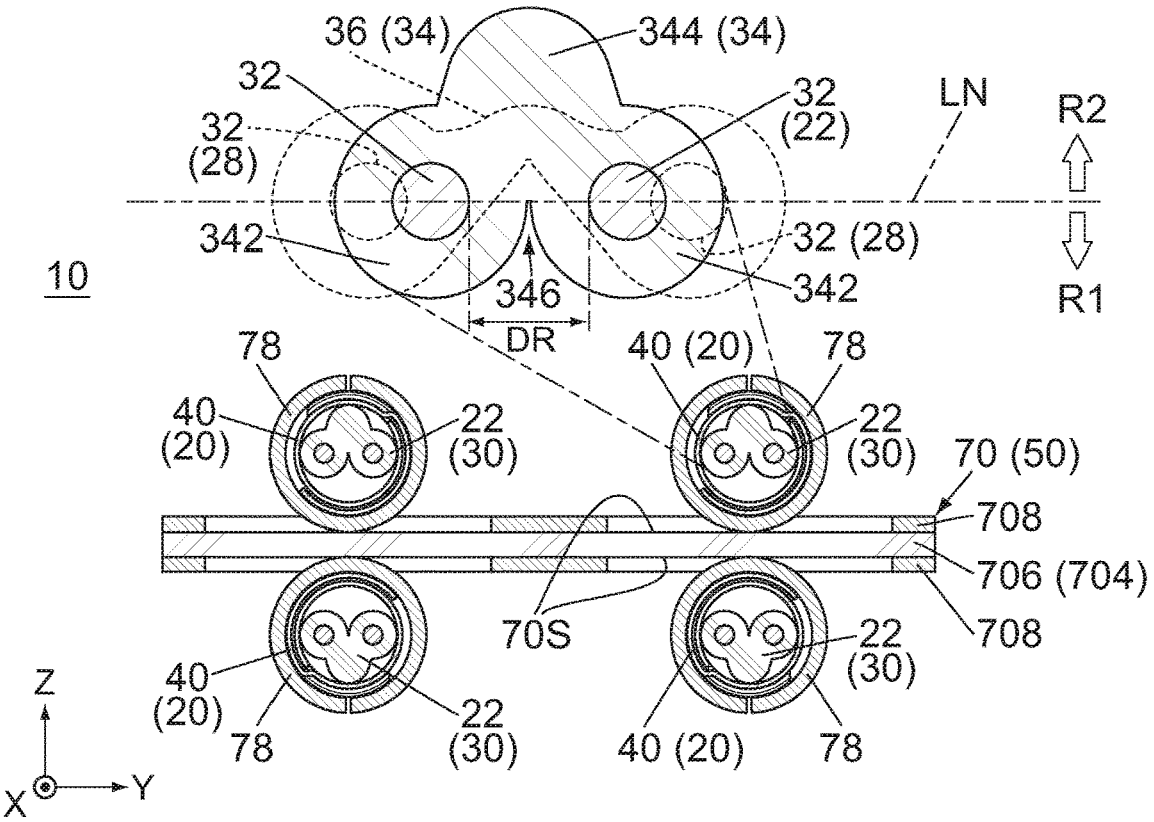
FIG. 6 is a cross-sectional view showing the connection structure of FIG. 1, taken along line VI-VI, wherein the line VI-VI is perpendicular to a front-rear direction and passes the middle of a cable-holding portion of the connection object in the front-rear direction, an inner member of the held section of one of the cables is enlarged and illustrated, and an outline of a pressed section of the cable is illustrated with dashed line in the enlarged view.

Referring to FIGS. 3, 5 and 6, the inner member 30 includes two wires 32 each made of conductor such as metal and an insulation body 34 which covers and binds the two wires 32. The insulation body 34 includes two coverings 342. The coverings 342 cover the wires 32, respectively. The cable 20 of the present embodiment comprises only two of the wires 32. The two wires 32 work as a differential pair for transmitting differential signals. However, the present invention is not limited thereto. For example, the two wires 32 may be members for transmitting signals independent from each other.

Each of the wires 32 of the present embodiment is formed of a plurality of fine metal wires (not shown) which are spirally twisted and has an annular shape in the cable cross-section. However, the present invention is not limited thereto. For example, each of the wires 32 may be a single metal wire. The shape of the wire 32 in the cable cross-section is not specifically limited.

Each of the coverings 342 of the present embodiment covers the corresponding wire 32 in the cable cross-section and has an annular shape in the cable cross-section. Each of the wires 32 is located at the center of the corresponding covering 342 in the cable cross-section. Thus, each of the coverings 342 entirely covers the corresponding wire 32 in the cable cross-section. However, the present invention is not limited thereto. For example, the covering 342 may have an oval ring shape or the other shape in the cable cross-section.

As can be seen from FIG. 1, when the cable 20 is under an initial state in which the cable 20 is not connected to the connection object 50, the inner member 30 has a particular cross-sectional shape as illustrated wherever the inner member 30 is cut in the predetermined direction along which the cable 20 extends. Referring to FIG. 6, the insulation body 34 of the inner member 30 under the initial state includes a ridge 344 in addition to the coverings 342 and is formed with a partition groove 346. The ridge 344 and the partition groove 346 are located between the two coverings 342 in a lateral direction (Y-direction) perpendicular to the predetermined direction are located at positions opposite to each other in an upper-lower direction (Z-direction) perpendicular to both the predetermined direction and the Y-direction. The ridge 344 projects from the coverings 342 along a projecting direction directed upward or downward. In other words, the ridge 344 projects along one of the positive Z-direction and the negative Z-direction. The partition groove 346 is depressed along the projecting direction.

In the cable cross-section, the partition groove 346 of the present embodiment is located in only one of two areas, namely an area R1 and an area R2, vertically divided by an imaginary straight line LN that passes the center points of the two wires 32. This arrangement makes it easy to keep a distance DR between the two wires 32 constant. However, the present invention is not limited thereto. For example, the partition groove 346 may be located over the two areas described above.

The partition groove 346 of the present embodiment is deeply depressed from an end of the coverings 342 in the Z-direction to the middle of the coverings 342 in the Z-direction. In addition, the ridge 344 has a projecting amount, or a size in the Z-direction, which is almost equal to a depressing amount, or a size in the Z-direction, of the partition groove 346. Referring to FIG. 6 together with FIGS. 9 and 11, this structure allows the ridge 344 to be formed with a deep incision 348. Only by elastically deforming the ridge 344 formed with the incision 348, the distance between the two wires 32 can be easily made large. However, the present invention is not limited thereto. For example, the partition groove 346 may be slightly depressed from the end of the coverings 342 in the Z-direction.

Hereafter, explanation will be made about the structure of the connection object 50.

As shown in FIGS. 1 and 2, the connection object 50 of the present embodiment comprises a connector 60, a base portion 70 and two pressing members 80. The base portion 70 is attached to a rear end (negative X-side end) of the connector 60 in a front-rear direction (X-direction) perpendicular to both the Y-direction and the Z-direction. However, the present invention is not limited thereto. For example, the connection object 50 may comprise only the base portion 70 and the pressing members 80.

Referring to FIG. 2, the connector 60 of the present embodiment comprises a housing 62 made of insulator, a shell 64 made of metal and a plurality of terminals (not shown) each made of conductor. Each of the terminals is accommodated in the housing 62 and held by the housing 62. The shell 64 encloses the housing 62 in a perpendicular plane (YZ-plane) perpendicular to the X-direction. However, the present invention is not limited thereto, but the structure of the connector 60 can be modified variously as necessary.

The base portion 70 of the present embodiment comprises a first member 702 made of insulator and a second member 704. The first member 702 is attached to the rear end of the connector 60. The second member 704 is a member formed separately from the first member 702 and is attached to a rear end of the first member 702. However, the present invention is not limited thereto. For example, the first member 702 and the second member 704 may be a single member inseparable from each other. The base portion 70 may be a paddle attachable to a universal serial bus (USB) TYPE-C connector. Thus, the connector 60 may be in compliant with USB TYPE-C standard.

The second member 704 of the present embodiment comprises a body portion 706 made of insulator and two plate-like portions 708 each formed of a metal plate. The body portion 706 has a flat plate-like shape in parallel to the XY-plane. One of the plate-like portions 708 is attached on an upper surface (positive Z-side surface) of the body portion 706 and covers the most part of the upper surface of the body portion 706. A remaining one of the plate-like portions 708 is attached on a lower surface (negative Z-side surface) of the body portion 706 and covers the most part of the lower surface of the body portion 706. The thus-provided plate-like portions 708 electromagnetically shield the inner member 30 exposed from the outer member 40 of the cable 20. However, the present invention is not limited thereto, but the plate-like portions 708 may be provided as necessary.

Figure 4:
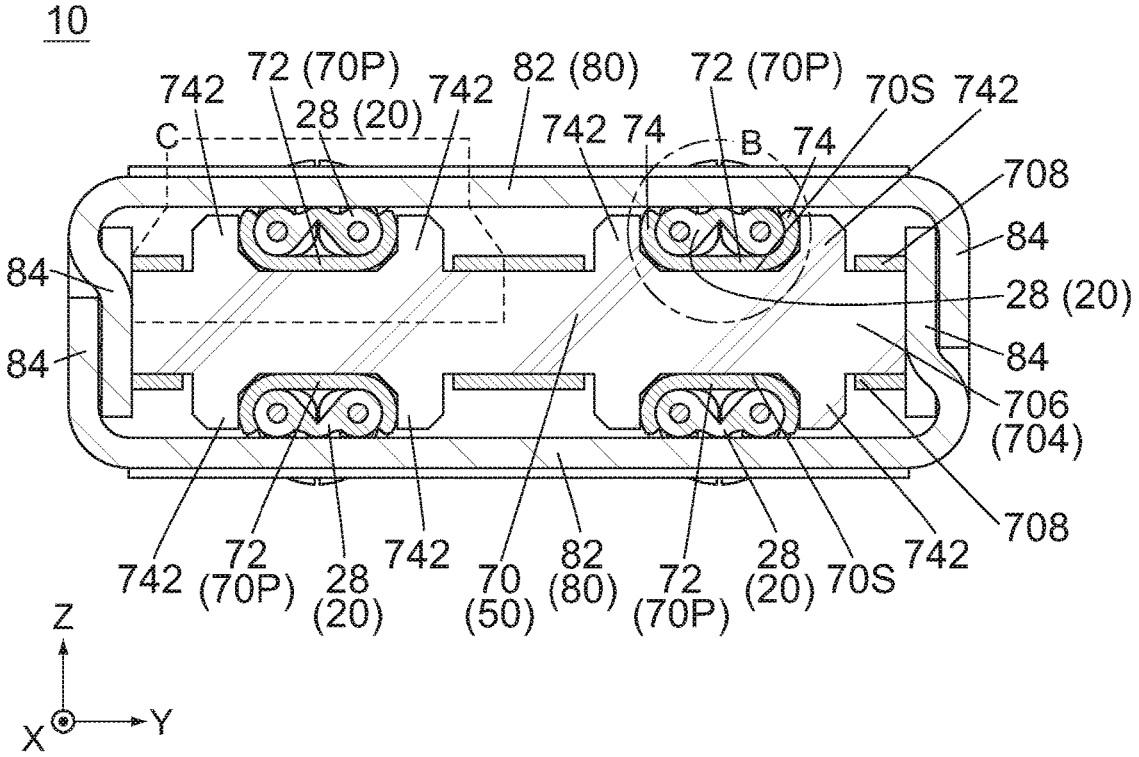
FIG. 4 is a cross-sectional view showing the connection structure of FIG. 1, taken along line IV-IV, wherein the line IV-IV is perpendicular to a front-rear direction and passes the middle of the pressing member in the front-rear direction.

Referring to FIGS. 2 to 4, according to the present embodiment, two of the cables 20 are attached to an upper side (positive Z-side) of the base portion 70, and the other two of the cables 20 are attached to a lower side (negative Z-side) of the base portion 70. Thus, the base portion 70 of the present embodiment has two attachment surfaces 70S to which the cables 20 are attached. One of the attachment surfaces 70S includes an upper surface of the first member 702 and the upper surface of the body portion 706 of the second member 704. A remaining one of the attachment surfaces 70S includes a lower surface of the first member 702 and the lower surface of the body portion 706 of the second member 704. However, the present invention is not limited thereto. For example, the base portion 70 may have only one of the attachment surfaces 70S. More specifically, the attachment surface 70S may be located only on the upper side of the base portion 70. In other words, the cables 20 may be attached only to the upper side of the base portion 70.

Referring to FIG. 2, each of the attachment surfaces 70S of the present embodiment is provided with two positioning mechanisms 70P, two pad pairs 76P and two cable-holding portions 78 for the two cables 20.

Referring to FIG. 4, the positioning mechanisms 70P have structures same as each other. The two positioning mechanisms 70P provided on one of the attachment surfaces 70S are arranged to be a mirror image of the other two positioning mechanisms 70P provided on a remaining one of the attachment surfaces 70S with respect to the XY-plane. Referring to FIG. 2, the pad pairs 76P have structures same as each other and are arranged mirror-symmetrically with respect to the XY-plane. The cable-holding portions 78 have structures same as each other and are arranged mirror-symmetrically with respect to the XY-plane. However, the present invention is not limited thereto. For example, each of the number of the positioning mechanisms 70P, the number of the pad pairs 76P and the number of the cable-holding portions 78 may be equal to the number of the cables 20 and thereby may be one or more. The arrangement of the positioning mechanisms 70P, the pad pairs 76P and the cable-holding portions 78 is not limited to that of the present embodiment but can be modified variously.

Hereafter, explanation will be made about one of the positioning mechanisms 70P, one of the pad pairs 76P and one of the cable-holding portions 78 for one of the cables 20. The following explanation is applicable to each of the positioning mechanisms 70P, the pad pairs 76P and the cable-holding portions 78 according to the present embodiment.

Referring to FIGS. 3 and 5, the positioning mechanism 70P of the present embodiment includes a catch portion 72, two side portions 74 and two reinforcement portions 742. The pad pair 76P of the present embodiment includes two pads 76. The two side portions 74 correspond to the coverings 342 of the cable 20, respectively. The two reinforcement portions 742 correspond to the side portions 74, respectively. The two pads 76 correspond to the wires 32 of the cable 20, respectively. Referring to FIG. 2, the cable-holding portion 78 of the present embodiment is a part for holding the cable 20.

Referring to FIGS. 3 and 5, as described above, for each of the cables 20, the base portion 70 of the present embodiment has the catch portion 72, the two side portions 74 corresponding to the coverings 342, respectively, the two reinforcement portions 742 corresponding to the side portions 74, respectively, the two pads 76 corresponding to the wires 32, respectively, and the cable-holding portion 78. However, the present invention is not limited thereto. For example, the side portions 74 and the reinforcement portions 742 may be provided as necessary as described later.

Referring to FIG. 4 together with FIG. 3, each of the catch portion 72 and the side portions 74 of the present embodiment is a part of the plate-like portion 708 of the second member 704. In particular, each of the side portions 74 is partially cut off from the plate-like portions 708 and is then bent to be away from the attachment surface 70S. Each of the reinforcement portions 742 of the present embodiment is a part of the body portion 706 of the second member 704. Each of the reinforcement portions 742 extends through the cut-off part of the plate-like portion 708 to be away from the attachment surface 70S. According to the present embodiment, the catch portion 72, the side portions 74 and the reinforcement portions 742 can be provided without increasing the number of the members of the base portion 70. However, the present invention is not limited thereto. For example, each of the catch portion 72, the side portions 74 and the reinforcement portions 742 may be a member formed separately from the second member 704. In another modification, a part of the attachment surface 70S may work as the catch portion 72.

Referring to FIG. 5, the catch portion 72 of the present embodiment is provided on the attachment surface 70S and is partially located between the two side portions 74 in the Y-direction. Each of the side portions 74 extends to be away from the attachment surface 70S in the Z-direction. The catch portion 72 and the side portions 74 of the present embodiment are arranged in a line in the Y-direction. The thus-arranged positioning mechanism 70P is formed with a receiving space 72R. The receiving space 72R is a space enclosed by the catch portion 72 and the side portions 74 in the YZ-plane. However, the present invention is not limited thereto. For example, the catch portion 72 may be apart from the side portions 74 in the X-direction. The receiving space 72R according to this arrangement is a space located between the side portions 74 in the Y-direction.

Each of the side portions 74 of the present embodiment is bent in the XY-plane so as to protrude outward in the Y-direction. Each of the thus-formed side portions 74 has a shape into which a part of the corresponding covering 342 of the cable 20 can be received. However, the present invention is not limited thereto. For example, each of the side portions 74 may linearly extend to be away from the attachment surface 70S in the Z-direction.

Referring to FIG. 3, the pads 76 correspond to the terminals (not shown) of the connector 60, respectively. Each of the pads 76 is provided on the attachment surface 70S and is connected to the corresponding terminal of the connector 60. The pads 76 are arranged in the Y-direction. Each of the pads 76 is located forward of the catch portion 72 (see FIG. 4) in the X-direction. In the present embodiment, the middle position between the two pads 76 in the Y-direction is matched with the middle position of the catch portion 72 in the Y-direction. Each of the thus-arranged pads 76 is provided on the attachment surface 70S of the first member 702. However, the present invention is not limited thereto. For example, each of the pads 76 may be provided on the attachment surface 70S of the second member 704.

Referring to FIG. 2 together with FIG. 5, the cable-holding portion 78 is located rearward of the catch portion 72, or faces toward the negative X-side of the catch portion 72. The catch portion 72 and the cable-holding portion 78 are apart from each other in the X-direction. In the X-direction, a distance dimension between the catch portion 72 and the cable-holding portion 78 is larger than the size of the catch portion 72. The cable-holding portion 78 of the present embodiment is formed of a part of the plate-like portion 708 which is partially cut off from the plate-like portion 708 and is then bent to be away from the attachment surface 70S. Thus, the cable-holding portion 78 is a part of the plate-like portion 708 of the second member 704. However, the present invention is not limited thereto. For example, the cable-holding portion 78 may be a member formed separately from the second member 704.

Referring to FIGS. 2 and 6, the cable-holding portion 78 is crimped around the cable 20 and thereby holds the cable 20. Thus, the cable 20 has a held section 22 that is held by the cable-holding portion 78. The held section 22 is a part of the cable 20. The held section 22 of the present embodiment includes a part of the inner member 30 and a part of the outer member 40. The cable-holding portion 78 is fastened around the outer member 40 of the held section 22 to be in contact with the shielding layer (not shown) of the tape 44 and indirectly holds the inner member 30. Thus, the shielding layer of the cable 20 is grounded to the base portion 70. However, the present invention is not limited thereto. For example, the cable-holding portion 78 may be in contact only with the insulating layer (not shown) of the tape 44. The held section 22 may be a part of the inner member 30. In other words, the cable-holding portion 78 may directly hold the inner member 30.

Referring to FIGS. 5 and 6, the cable-holding portion 78 of the present embodiment holds the held section 22 of the cable 20 so that the two coverings 342 are arranged in the Y-direction. The middle position of the cable-holding portion 78 in the Y-direction is matched with the middle position of the catch portion 72 in the Y-direction. When the thus-arranged cable-holding portion 78 holds the cable 20, the middle position between the two coverings 342 of the cable 20 in the Y-direction is matched with the middle position of the catch portion 72 in the Y-direction.

Referring to FIG. 6, the inner member 30 of the held section 22 has a structure same as that of the cable 20 under the previously described initial state. In detail, the insulation body 34 of the held section 22 includes the ridge 344 and is formed with the partition groove 346. The ridge 344 and the partition groove 346 are located between the two coverings 342 in the Y-direction and are located at positions opposite to each other in the Z-direction. The ridge 344 projects along the projecting direction directed upward or downward. The partition groove 346 is depressed along the projecting direction.

The projecting direction of the present embodiment is a direction extending away from the base portion 70 along the Z-direction. More specifically, the projecting direction of the inner member 30 shown in the enlarged view of FIG. 6 is the upward direction, or the positive Z-direction. In the inner member 30 shown in the enlarged view, the ridge 344 projects upward from an upper end (positive Z-side end) of the coverings 342, and the partition groove 346 is depressed upward from a lower end (negative Z-side end) of the coverings 342 to the middle of the coverings 342 in the Z-direction. However, the projecting direction according to the present invention can be modified as described later.

According to the present embodiment, the held section 22 has the cable cross-section in which the partition groove 346 is located in only one of the two areas, namely the area R1 and the area R2, vertically divided by the imaginary straight line LN that passes the center points of the two wires 32. The partition groove 346 of the present embodiment is located only in the area R1 which is near to the base portion 70 in the Z-direction. However, the present invention is not limited thereto, but the partition groove 346 may be located only in the area R2 which is far from the base portion 70 in the Z-direction.

Hereafter, explanation will be made about the pressing members 80 (see FIG. 2).

Referring to FIG. 2, the two pressing members 80 of the present embodiment have shapes same as each other. Each of the pressing members 80 is a single metal plate with bends and has a pressing portion 82, two protruding portions 83 and two arms 84.

The pressing portion 82 has a flat plate-like shape which extends in parallel to the XY-plane. The protruding portions 83 are located at opposite sides of the pressing portion 82 in the X-direction, respectively. Each of the protruding portions 83 extends along the pressing portion 82 in the Y-direction. Each of the protruding portions 83 protrudes outward in the X-direction from the pressing portion 82 while being away from the base portion 70 in the Z-direction. The arms 84 are located at opposite ends of the pressing portion 82 in the Y-direction, respectively. Each of the arms 84 extends from the pressing portion 82 toward the base portion 70 in the Z-direction. Each of the arms 84 is formed with an attachment projection 86 and an attachment hole 88. The attachment projection 86 projects inward in the Y-direction. The attachment hole 88 passes through the arm 84 in the Y-direction.

Referring to FIG. 2 together with FIG. 1, the two pressing members 80 of the present embodiment are attached to the base portion 70 so as to vertically sandwich a part of the base portion 70 located forward of the cable-holding portion 78. Thus, each of the pressing members 80 is located forward of the cable-holding portion 78. The attachment projection 86 of one of the pressing members 80 is received in the attachment hole 88 of a remaining one of the pressing members 80, so that the two pressing members 80 are coupled to each other while the pressing portion 82 presses a part of the inner member 30 of the cable 20 against the base portion 70.

Each of the pressing members 80 of the present embodiment is attached to the base portion 70 without direct fixation thereof to the base portion 70. However, the present invention is not limited thereto. Neither the structure of the pressing member 80 nor the attachment method thereof to the base portion 70 is specifically limited, provided that the pressing member 80 can be attached to the base portion 70 so as to elastically deform a part of the inner member 30. For example, each of the pressing members 80 may be directly fixed to the base portion 70.

Hereafter, explanation will be made about the function of one of the positioning mechanisms 70P for one of the cables 20. The following explanation is applicable to each of the positioning mechanisms 70P according to the present embodiment.

Referring to FIG. 1, the cable 20 has a pressed section 28. The pressed section 28 is a part of the inner member 30 of the cable 20. The pressed section 28 is pressed against the base portion 70 by the pressing portion 82 of the pressing member 80 along the Z-direction to be elastically deformed. In other words, the pressed section 28 is a part of the cable 20 which is sandwiched and pressed between the pressing portion 82 and the base portion 70 in the Z-direction. Referring to FIGS. 3 and 5, the pressed section 28 of the present embodiment is partially located at a position same as that of the side portions 74 in the X-direction. However, the present invention is not limited thereto. For example, the pressed section 28 may be entirely located at a position same as that of the side portions 74 in the X-direction.

Referring to FIG. 5, the insulation body 34 of the pressed section 28 includes a coupling strip 36 in addition to the two coverings 342. Referring to FIG. 5 together with FIG. 9, the ridge 344 is elastically deformed so as to form the coupling strip 36. In detail, the ridge 344 is formed with the incision 348, and then the insulation body 34 is vertically pressed by the pressing member 80 to be elastically deformed, so that the coupling strip 36 is formed. Thus, the coupling strip 36 is the pressed and elastically deformed ridge 344. The coupling strip 36 couples the two coverings 342 to each other in the Y-direction. The coupling strip 36 of the present embodiment can be formed by elastically deforming the cable 20 as described below.

Figure 8:
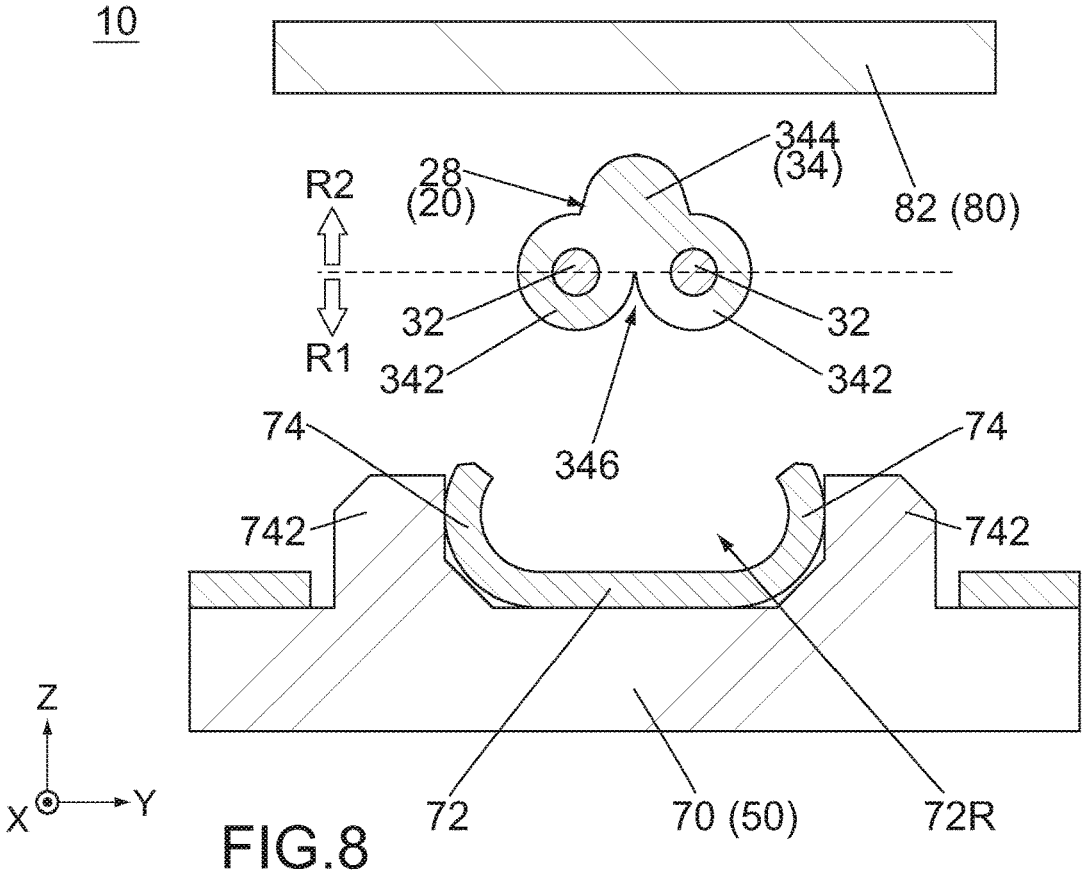
FIG. 8 is an end view showing a part of the connection structure of FIG. 4 enclosed by dashed line C, wherein the connection structure is under a state where a formation step of the forming method of FIG. 7 is performed, and an outer member of the cable is removed.
Figure 9:
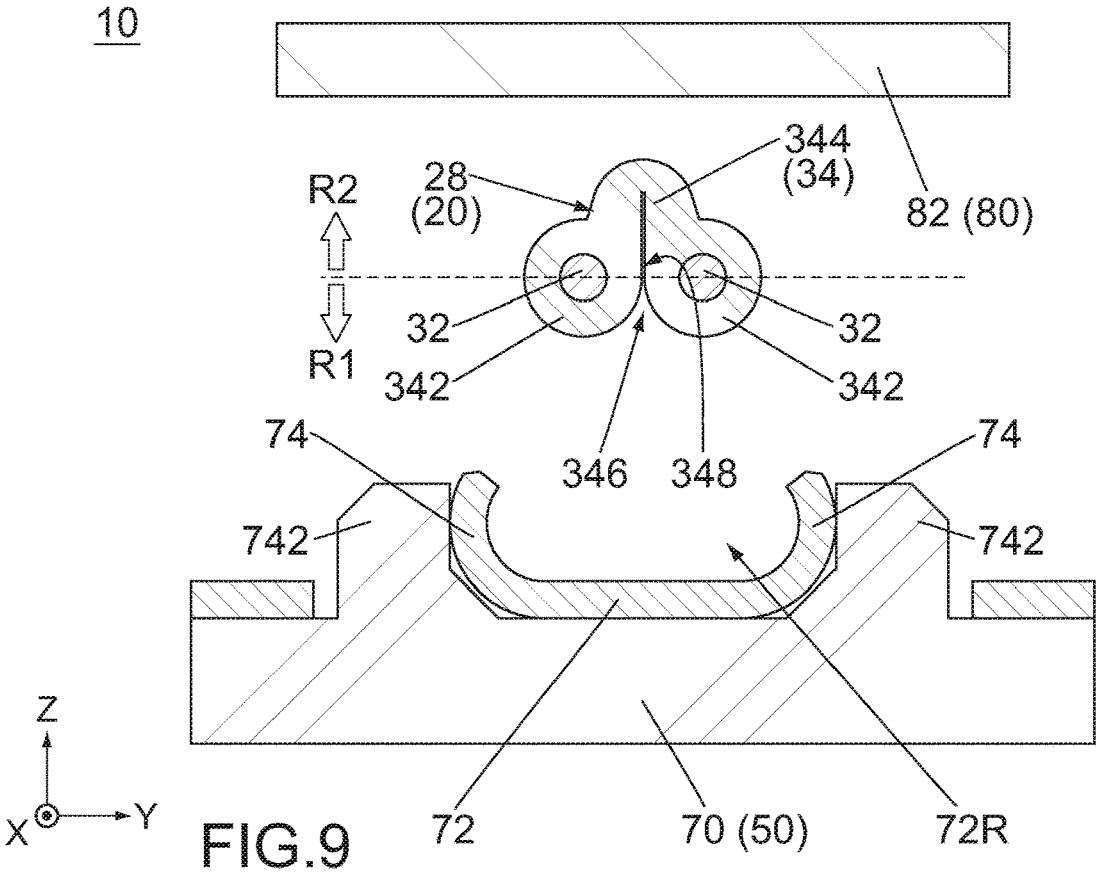
FIG. 9 is an end view showing the connection structure of FIG. 8, wherein the connection structure is under a state where the formation step is ended.

Referring to FIGS. 8 and 9, first, a bottom wall of the partition groove 346 of the cable 20, which extends along the X-direction, is partially formed with the incision 348 extending along the X-direction. The incision 348 is formed so as to extend from the bottom wall of the partition groove 346 toward the top of the ridge 344 in the Z-direction and to extend by a predetermined length in the X-direction. From a viewpoint of prevention of damage of the wires 32, it is preferable that the incision 348 be formed in the middle between the two coverings 342. The incision 348 may have any depth, provided that the coupling strip 36 (see FIG. 13) having a required size in the Y-direction can be formed while the two coverings 342 are not individually separated from each other. The incision 348 may have any length in the X-direction, provided that the coupling strip 36 can be formed to have the required size. For example, in a case where the coupling strip 36 needs to have a large size in the Y-direction, the projecting amount of the ridge 344 should be made large, and the incision 348 should be formed to be deep and to be long in the Y-direction. In this case, the top end of the incision 348 may be located in the area R2 similarly to the present embodiment.

Referring to FIG. 9, then, the cable 20 is arranged so that one of the ridge 344 and the incision 348 faces the catch portion 72. The incision 348 shown in FIG. 9 faces the catch portion 72 in the Z-direction so that the ridge 344 projects upward to be away from the catch portion 72. However, the present invention is not limited thereto, but the ridge 344 may be arranged to face the catch portion 72 in the Z-direction.

Referring to FIGS. 10 to 13, then, the pressing members 80 are attached to the base portion 70, and the pressed section 28 of the cable 20 formed with the incision 348 is sandwiched and pressed between the pressing member 80 and the catch portion 72 in the Z-direction. The ridge 344 of the thus-sandwiched pressed section 28 is elastically deformed to be spread in the Y-direction, so that the coupling strip 36 is formed. Meanwhile, the two coverings 342 are moved to be away from each other in the Y-direction while being coupled to each other by the coupling strip 36.

Figure 13:
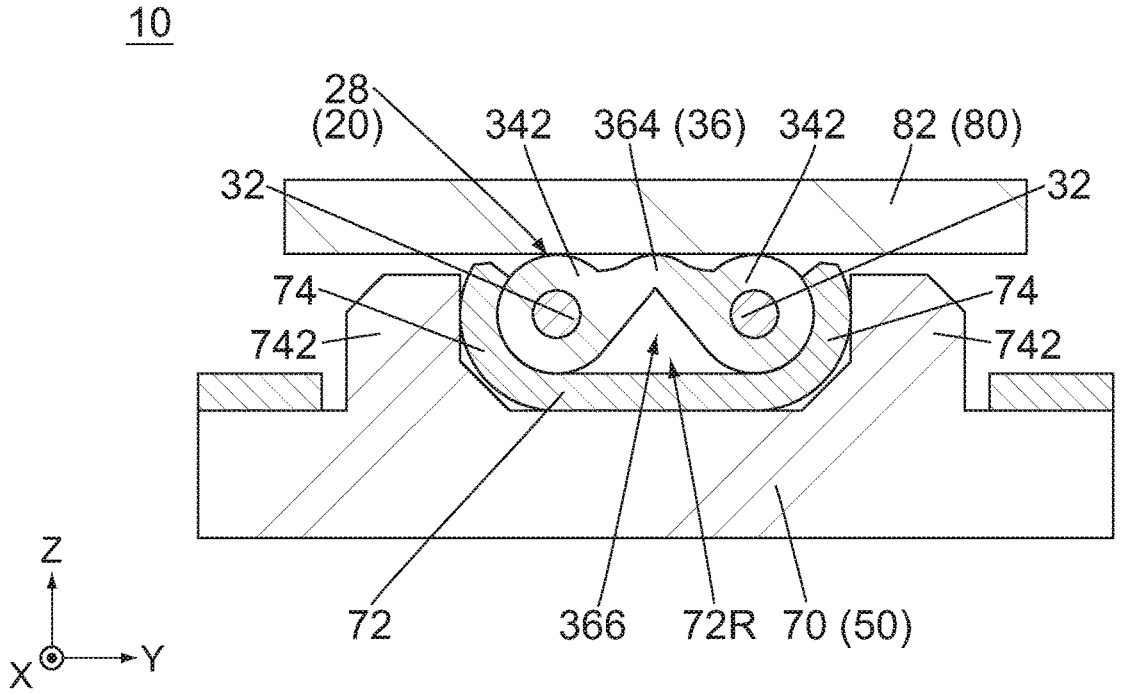
FIG. 13 is an end view showing the connection structure of FIG. 8, wherein the connection structure is under a state where the attachment step is ended.

Referring to FIGS. 5 and 13, when the attachment of the pressing member 80 to the base portion 70 is ended, the formation of the coupling strip 36 is ended. Referring to FIG. 5, when the formation of the coupling strip 36 is ended, the middle of the coupling strip 36 in the Y-direction is bent to be away from the catch portion 72. In detail, the coupling strip 36 includes a middle ridge 364 and is formed with a middle groove 366. The middle ridge 364 and the middle groove 366 are located between the two coverings 342 in the Y-direction and are located at positions opposite to each other in the Z-direction. The middle ridge 364 projects along the projecting direction. The middle groove 366 is depressed along the projecting direction. The projecting direction of the present embodiment is a direction away from the catch portion 72 in the Z-direction. The projecting direction of the pressed section 28 shown in FIG. 5 is the upward direction, or the positive Z-direction.

According to the present embodiment, when the formation of the coupling strip 36 is ended, the middle ridge 364 projects to be away from the catch portion 72 in the Z-direction and is in contact with the pressing member 80. In detail, the middle ridge 364 is in contact with the pressing portion 82 of the pressing member 80 and is pressed toward the catch portion 72 by the pressing portion 82.

Meanwhile, the two coverings 342 of the pressed section 28 are in contact with the pressing portion 82 and the catch portion 72 and are vertically pressed by the pressing portion 82 and the catch portion 72. In other words, the two coverings 342 of the pressed section 28 are sandwiched and pressed between the pressing member 80 and the catch portion 72 in the Z-direction. Therefore, even in a case where the side portions 74 and the reinforcement portions 742 are not provided, when the pressing member 80 is further pressed against the pressed section 28, each of the coverings 342 is elastically deformed to be compressed in the Z-direction but is almost unmoved in the Y-direction. Thus, when the formation of the coupling strip 36 is ended, the two wires 32 of the pressed section 28 are positioned relative to the middle ridge 364.

Referring to FIG. 2, the held section 22 is located rearward of and apart from the pressing member 80. The thus-located held section 22 does not directly receive the force applied from the pressing member 80. Therefore, the held section 22 is hardly deformed. Referring to FIG. 5, when the formation of the coupling strip 36 is ended, in the Y-direction, a distance DP between the two wires 32 of the pressed section 28 is longer than the distance DR between the two wires 32 of the held section 22. Thus, the two wires 32 of the pressed section 28 are positioned to be apart from each other by the required distance DP.

According to the present embodiment as described above, only by forming the partial incision 348 (see FIG. 9) in the cable 20 and by vertically sandwiching and pressing the cable 20, the two wires 32 can be apart from each other by the required distance while they are not individually separated from each other. In addition, the two wires 32 can be kept apart from each other by the required distance. Thus, the present embodiment provides the connection structure 10 which allows the two wires 32 thereof to be apart from each other by the required distance and enables the required distance between the wires 32 to be kept.

Referring to FIG. 5, the pressed section 28 of the present embodiment is located between the two side portions 74 in the Y-direction. Each of the coverings 342 of the pressed section 28 is pressed against the corresponding side portion 74 and is in contact with the corresponding side portion 74. Referring to FIG. 3, each of the wires 32 is located at a position same as that of the corresponding pad 76 in the Y-direction. Thus, the two side portions 74 of the present embodiment simultaneously position the two wires 32 relative to the pads 76 in the Y-direction. However, the present invention is not limited thereto. For example, referring to FIG. 5, at least one of the coverings 342 of the pressed section 28 may be in contact with the corresponding side portion 74.

Referring to FIG. 3, each of the wires 32 has an exposed portion 322 exposed from the covering 342. Each of the exposed portions 322 is positioned as described above and is then fixed on and connected to the corresponding pad 76 via soldering, etc. Each of the thus-fixed wires 32 is electrically connected to the corresponding terminal (not shown) of the connector 60 via the corresponding pad 76.

Referring to FIG. 5, according to the present embodiment, the pressure applied from the pressing member 80 causes a movement of each of the coverings 342 in the Y-direction without substantial deformation thereof while the ridge 344 is easily deformed so that the coupling strip 36 is formed. Meanwhile, the coverings 342 are brought into contact with a surface of the catch portion 72 which is a horizontal plane in parallel to the XY-plane. According to this structure, the coverings 342 might be hardly moved in the Y-direction because of a friction force between the coverings 342 and the catch portion 72. In such a case, lubricating oil (not shown) may be applied to the catch portion 72.

Referring to FIG. 2, each of the pressing members 80 has the protruding portions 83 which slope to be away from the pressed section 28 of the cable 20. The protruding portions 83 strengthen the pressing member 80. More specifically, each of the pressing members 80 is hard to be bent because of the protruding portions 83 described above. In addition, since the protruding portions 83 are provided as described above, each of the pressing members 80 is able to press the pressed section 28 with no damage of the pressed section 28. For example, even in a case where each of the pressing members 80 presses three or more of the cables 20 arranged in the Y-direction, the pressed sections 28 can be pressed by forces equal to one another. However, the present invention is not limited thereto. For example, the protruding portions 83 may be provided as necessary. The structure for strengthening the pressing member 80 is not limited to the protruding portions 83 of the present embodiment but can be variously modified.

Referring to FIG. 2, when the cable 20 of the present embodiment is seen along the Z-direction, the two coverings 342 extend between the pressed section 28 and the held section 22 with no intersection with each other. In other words, the inner member 30 of the cable 20 is not twisted while extending along the X-direction. The inner member 30 of the present embodiment has a structure that is hard to be twisted. However, the base portion 70 may be further provided with a twist prevention mechanism.

Referring to FIGS. 4 and 5, each of the reinforcement portions 742 of the present embodiment is located outward of the corresponding side portion 74 in the Y-direction and is partially in contact with the corresponding side portion 74. Referring to FIG. 5, each of the side portions 74 of the present embodiment is reinforced by the reinforcement portions 742. Each of the thus-reinforced side portions 74 securely receives and positions the corresponding covering 342 when the corresponding covering 342 is pressed against the side portion 74. However, the present invention is not limited thereto, but the reinforcement portions 742 may be provided as necessary.

The connection structure 10 of the present embodiment can be further variously modified in addition to the already explained modifications.

Figure 14:
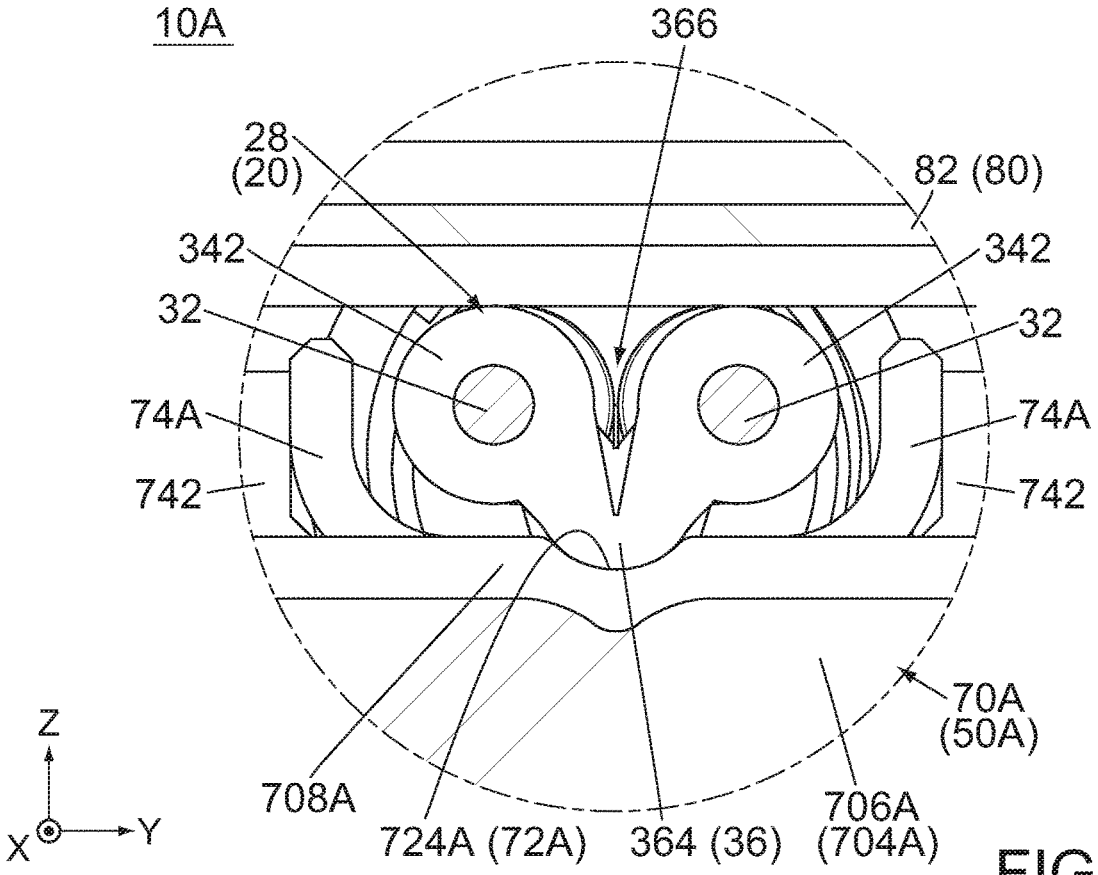
FIG. 14 is a cross-sectional view showing a modification of the connection structure of FIG. 5, wherein the cutting-plane line is perpendicular to the front-rear direction and passes a front end of the pressing member in the front-rear direction, and the connection structure is under a state where the attachment step is performed.

Referring to FIG. 14, a connection structure 10A according to a modification comprises the cable 20 same as that of the connection structure 10 (see FIG. 2) and a connection object 50A different from the connection object 50 (see FIG. 2) of the connection structure 10. The connection object 50A comprises the connector 60 (see FIG. 2) and the pressing member 80 same as those of the connection object 50 and a base portion 70A different from the base portion 70 (see FIG. 2) of the connection object 50. The base portion 70A comprises the first member 702 (see FIG. 2) same as that of the base portion 70 and a second member 704A different from the second member 704 (see FIG. 2) of the base portion 70. The second member 704A comprises a body portion 706A and a plate-like portion 708A different from those of the second member 704. The body portion 706A is partially depressed. The plate-like portion 708A is formed with a depression 724A depressed toward the body portion 706A.

The base portion 70A has a catch portion 72A and two side portions 74A instead of the catch portion 72 (see FIG. 5) and the two side portions 74 (see FIG. 5) of the base portion 70 (see FIG. 5). The catch portion 72A is formed with the depression 724A. The depression 724A is located at the middle of the catch portion 72A in the Y-direction and is depressed to be away from the pressing member 80 in the Z-direction. Each of the side portions 74A extends straight away from the body portion 706A in the Z-direction. Except for the differences described above, the connection structure 10A has a structure similar to that of the connection structure 10 (see FIG. 5).

The coupling strip 36 of the connection structure 10A is formed as described below. First, the incision 348 (see FIG. 10) similar to that of the connection structure 10 (see FIG. 10) is formed. Then, the cable 20 is arranged so that the ridge 344 (see FIG. 10) faces the catch portion 72A in the Z-direction. The thus-arranged ridge 344 is partially received in the depression 724A. Then, the pressed section 28 formed with the incision 348 is sandwiched and pressed between the pressing member 80 and the catch portion 72A in the Z-direction. As a result, the ridge 344 is elastically deformed to be spread in the Y-direction, so that the coupling strip 36 is formed. Meanwhile, the two coverings 342 are moved to be away from each other in the Y-direction while being coupled by the coupling strip 36.

When the attachment of the pressing member 80 to the base portion 70A is ended, the formation of the coupling strip 36 is ended. When the formation of the coupling strip 36 is ended, the middle ridge 364 projects along the projecting direction, and the middle groove 366 is depressed along the projecting direction. The projecting direction of the present modification is a direction extending toward the catch portion 72 in the Z-direction. The projecting direction of the pressed section 28 shown in FIG. 14 is the downward direction, or the negative Z-direction.

As can be seen from FIG. 14, when the formation of the coupling strip 36 is ended, the middle ridge 364 projects toward the catch portion 72A in the Z-direction and is in contact with the catch portion 72A. Meanwhile, the two coverings 342 of the pressed section 28 are sandwiched and pressed between the pressing member 80 and the catch portion 72A in the Z-direction, similarly to the previously described embodiment. As a result, the two wires 32 of the pressed section 28 are positioned relative to the middle ridge 364. Similarly to the previously described embodiment, the present modification provides the connection structure 10A which allows the two wires 32 thereof to be apart from each other by the required distance and enables the required distance between the wires 32 to be kept. In addition, the present modification enables the middle ridge 364 to be positioned by the depression 724A.

Referring to FIGS. 5 and 14, according to the present embodiment and the modification, the middle ridge 364 of the pressed section 28 is in contact with one of the pressing member 80 and the catch portion 72 (the catch portion 72A). Moreover, the two coverings 342 of the pressed section 28 are in contact with the pressing member 80 and the catch portion 72 (the catch portion 72A). Thus, the pressed section 28 is securely held at five points. However, the present invention is not limited thereto. The two coverings 342 of the pressed section 28 may be in contact with at least a remaining one of the pressing member 80 and the catch portion 72 (the catch portion 72A). In other words, the two coverings 342 may be in contact with a member or a portion that is not in contact with the middle ridge 364.

Figure 15:
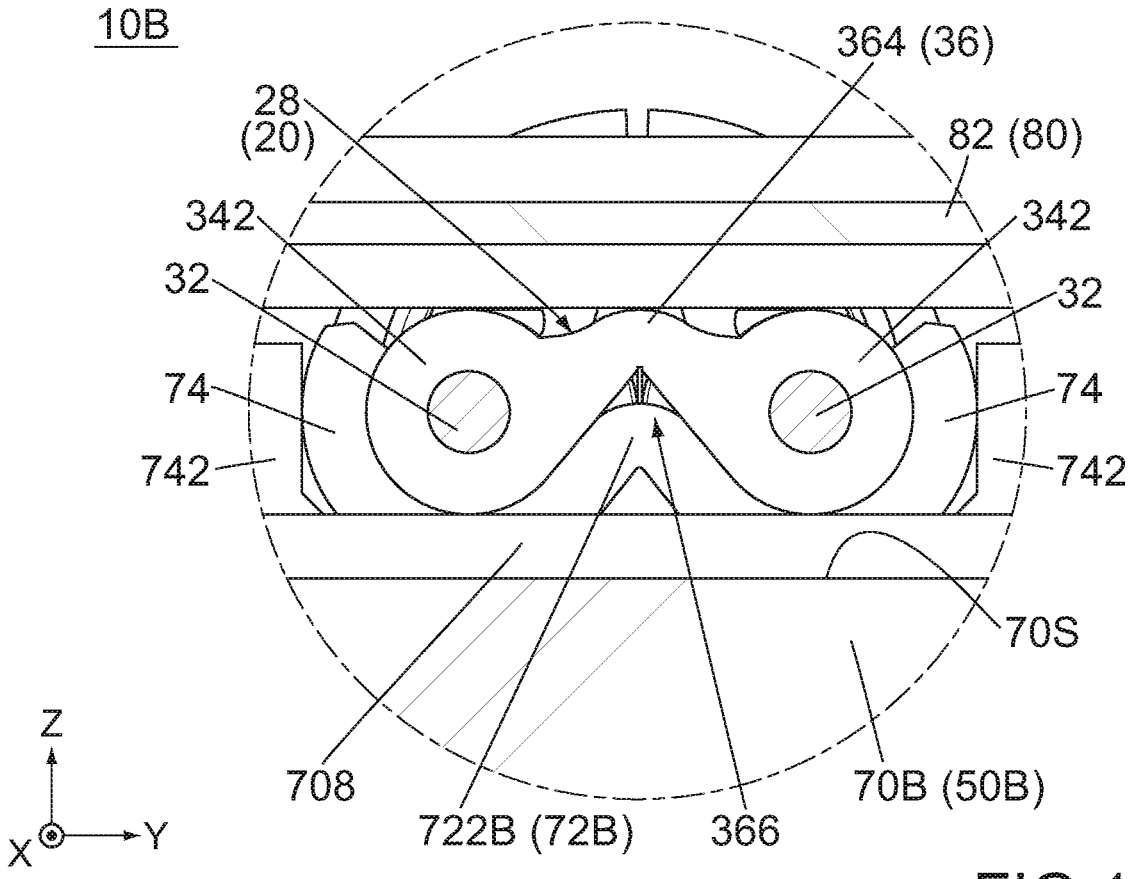
FIG. 15 is a cross-sectional view showing another modification of the connection structure of FIG. 5, wherein the cutting-plane line is perpendicular to the front-rear direction and passes the front end of the pressing member in the front-rear direction.
Figure 16:
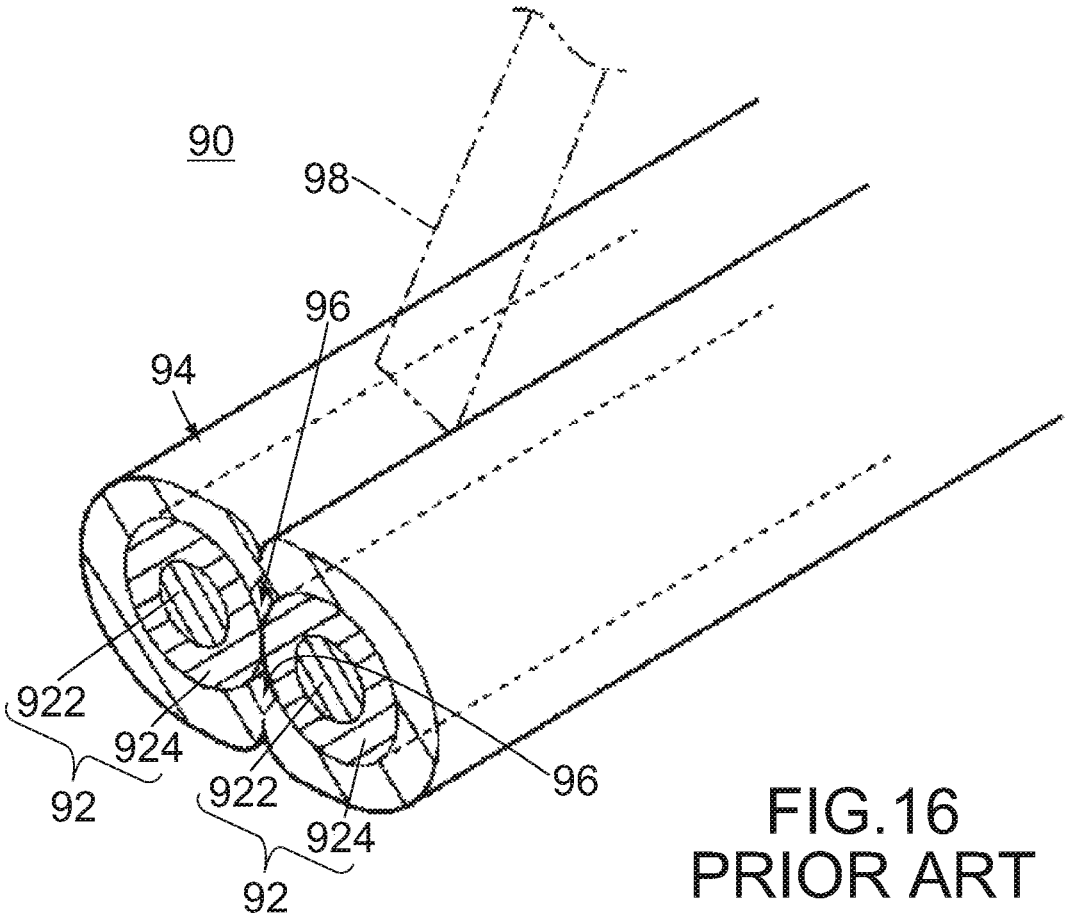
FIG.16 PRIOR ART
FIG. 16 is a perspective view showing a cable of Patent Document 1.

Referring to FIG. 15, a connection structure 10B according to another modification comprises the cable 20 same as that of the connection structure 10 (see FIG. 2) and a connection object 50B different from the connection object 50 (see FIG. 2) of the connection structure 10. The connection object 50B comprises the connector 60 (see FIG. 2) and the pressing member 80 same as those of the connection object 50 and a base portion 70B different from the base portion 70 (see FIG. 2) of the connection object 50. The base portion 70B comprises the first member 702 (see FIG. 2) and the second member 704 (see FIG. 2) same as those of the base portion 70 while comprising a catch portion 72B different from the catch portion 72 (see FIG. 5) of the base portion 70. The catch portion 72B is provided with a projection 722B. The projection 722B is located at the middle of the catch portion 72B in the Y-direction and projects to be away from the attachment surface 70S. Except for the differences described above, the connection structure 10B has a structure similar to that of the connection structure 10 (FIG. 2).

Referring to FIG. 15 together with FIGS. 8 to 13, the two wires 32 of the pressed section 28 of the connection structure 10B can be positioned relative to the middle ridge 364 similarly to the connection structure 10. Similarly to the previously described embodiment, the present modification provides the connection structure 10B which allows the two wires 32 thereof to be apart from each other by the required distance and enables the required distance between the wires 32 to be kept.

Referring to FIG. 15, the two coverings 342 of the pressed section 28 of the present modification are moved along slopes of the projection 722B to be away from each other. This structure reduces affection due to a friction force between the coverings 342 and the catch portion 72B. In addition, the projection 722B is located between the two coverings 342 of the pressed section 28 in the Y-direction. According to the present modification, even if none of the side portions 74 is provided, the two wires 32 can be positioned at required positions depending on the size of the projection 722B in the Y-direction.

The projection 722B of the present modification is provided on the catch portion 72B. However, the present invention is not limited thereto. For example, the pressing portion 82 of the pressing member 80 may be provided with a projection which has a shape obtained by vertically inverting the projection 722B. According to this structure, the cable 20 may be arranged so that the projection of the pressing portion 82 is located between the coverings 342 which are located at opposite sides of the partition groove 346 (see FIG. 10), respectively. Thus, one of the catch portion 72 and the pressing member 80 may be provided with a projection.

Hereafter, explanation will be made about an example of a forming method which forms the connection structure 10 (see FIG. 1) comprising the cables 20 and the connection object 50 (see FIG. 1). The connection structure 10A (see FIG. 14) and the connection structure 10B (see FIG. 14) can be formed by a forming method similar to the forming method described below.

Figure 7:
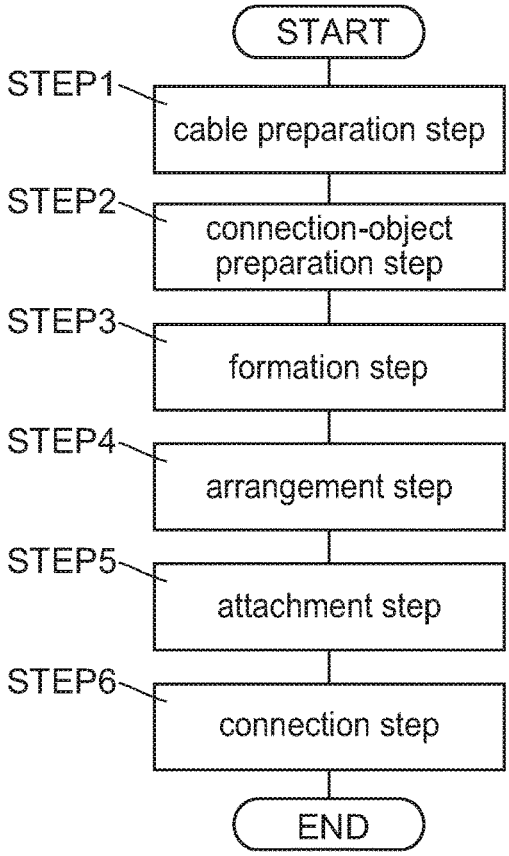
FIG. 7 is a flowchart showing an example of a forming method for forming the connection structure of FIG. 1.

Referring to FIG. 7, the forming method of the present embodiment comprises at least six steps, namely a cable preparation step (STEP 1), a connection-object preparation step (STEP 2), a formation step (STEP 3), an arrangement step (STEP 4), an attachment step (STEP 5) and a connection step (STEP 6). Hereafter, explanation will be made about the forming method of the present embodiment along starting orders of the steps.

Referring to FIG. 2, in the first step, or in the cable-preparation step (see FIG. 7), a necessary number of the cables 20 each having the previously described initial state structure is prepared. Thus, referring to FIG. 6, the forming method of the present embodiment comprises preparing the cable 20, the cable 20 including the two wires 32 and the insulation body 34 which covers and binds the two wires 32, the insulation body 34 including the two coverings 342 and the ridge 344 and being formed with the partition groove 346, the coverings 342 covering the wires 32, respectively, the ridge 344 and the partition groove 346 being located between the two coverings 342 in the Y-direction perpendicular to the predetermined direction along which the cable 20 extends and being located at positions opposite to each other in the Z-direction perpendicular to both the predetermined direction and the Y-direction, the ridge 344 projecting along the projecting direction directed upward or downward, the partition groove 346 being depressed along the projecting direction.

Referring to FIG. 2, in the next step, or in the connection-object preparation step (see FIG. 7), the connection object 50 having the previously described structure is prepared. Thus, referring to FIG. 2 together with FIG. 5, the forming method of the present embodiment comprises preparing the connection object 50, the connection object 50 comprising the base portion 70 and the pressing member 80, the base portion 70 having the attachment surface 70S, the catch portion 72, the two pads 76 and the cable-holding portion 78, the pads 76 corresponding to the wires 32, respectively, the catch portion 72 being provided on the attachment surface 70S, each of the pads 76 being provided on the attachment surface 70S and being located forward of the catch portion 72 in the X-direction perpendicular to both the Y-direction and the Z-direction, the cable-holding portion 78 being located rearward of the catch portion 72.

The base portion 70 of the connection object 50 may have the two side portions 74 which correspond to the coverings 342, respectively. Each of the side portions 74 may extend to be away from the attachment surface 70S in the Z-direction. The catch portion 72 may be located between the two side portions 74 in the Y-direction. Referring to FIG. 15, one of the catch portion 72 and the pressing member 80 may be provided with the projection 722B.

Referring to FIG. 3, in the next step, or in the formation step (see FIG. 7), a front end (positive X-side end) of the outer member 40 of the cable 20 is removed so that a front end of the inner member 30 is exposed. The coverings 342 of the thus-exposed front end are partially removed via laser processing, for example, so that the wires 32 are partially exposed. Moreover, the incision 348 (see FIG. 10) is formed in the bottom wall of the partition groove 346 (see FIG. 10) located rearward of the exposed wires 32. Thus, the forming method of the present embodiment comprises forming the exposed portion 322 of each of the wires 32 and forming the pressed section 28 of the cable 20, each of the exposed portion 322 being exposed from the covering 342, the pressed section 28 having the incision 348 extending along the X-direction, the incision 348 being formed in a part of the wall of the partition groove 346 located rearward of the exposed portions 322.

According to the formation step of the present embodiment, a front end of the wire 32 is exposed. However, the present invention is not limited thereto. For example, the wires 32 may be partially exposed while front ends of the coverings 342 are not removed. The formation of the exposed portions 322 may be performed before the formation of the incision 348 or may be performed after the formation of the incision 348.

Figure 10:
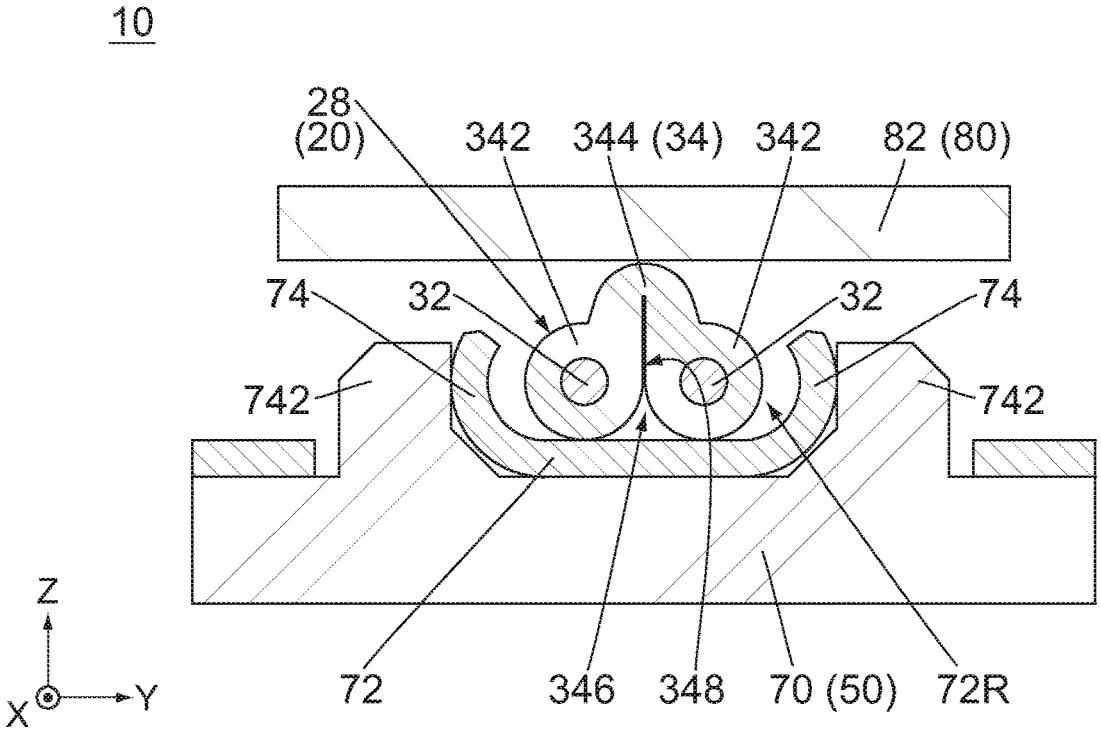
FIG. 10 is an end view showing the connection structure of FIG. 8, wherein the connection structure is under a state where an arrangement step of the forming method of FIG. 7 is ended.

Referring to FIG. 10 together with FIGS. 2 and 3, in the next step, or in the arrangement step (see FIG. 7), the cable 20 is arranged so that the ridge 344 or the incision 348 faces the catch portion 72. Meanwhile, a part of the cable 20 located rearward of the pressed section 28 is held by the cable-holding portion 78, and each of the exposed portions 322 is arranged in the vicinity of the corresponding pad 76. For example, each of the exposed portions 322 is arranged inward of the corresponding pad 76 in the Y-direction. Instead, each of the exposed portions 322 may be arranged to face, at least in part, the corresponding pad 76 in the Z-direction. In other words, each of the exposed portions 322 is arranged so that a position of each of the exposed portions 322 in the X-direction is, at least in part, overlapped with another position of the corresponding pad 76 in the X-direction.

Thus, the forming method of the present embodiment comprises arranging the cable 20, one of the ridge 344 and the incision 348 of the pressed section 28 of the arranged cable 20 facing the catch portion 72, the arranged cable 20 having the held section 22 which is located rearward of the pressed section 28 and is held by the cable-holding portion 78, each of the exposed portions 322 of the arranged cable 20 being located, at least in part, at a position same as that of the corresponding pad 76 in the X-direction.

In the arrangement step (see FIG. 7), the pressed section 28 may be arranged between the two side portions 74 in the Y-direction. In addition or instead, the two coverings 342 of the pressed section 28 may be arranged so that the projection 722B (see FIG. 15) is located therebetween in the Y-direction.

Figure 11:
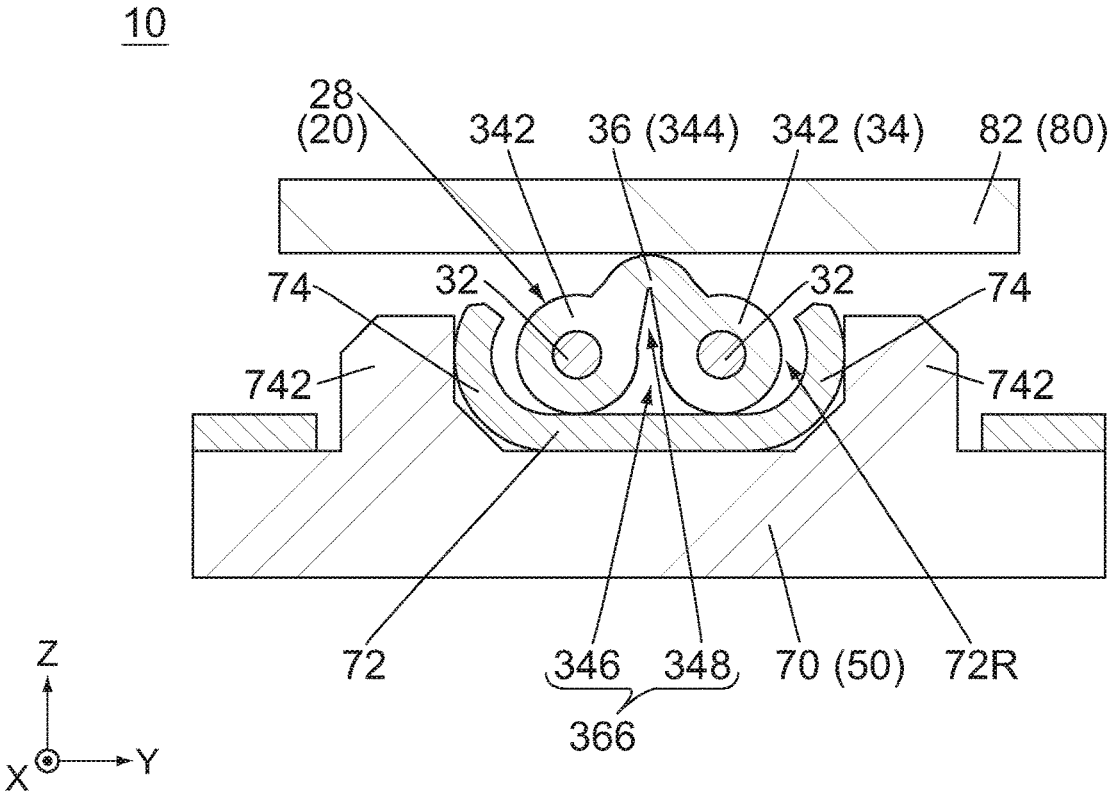
FIG. 11 is an end view showing the connection structure of FIG. 8, wherein the connection structure is under a state where an attachment step of the forming method of FIG. 7 is started.
Figure 12:
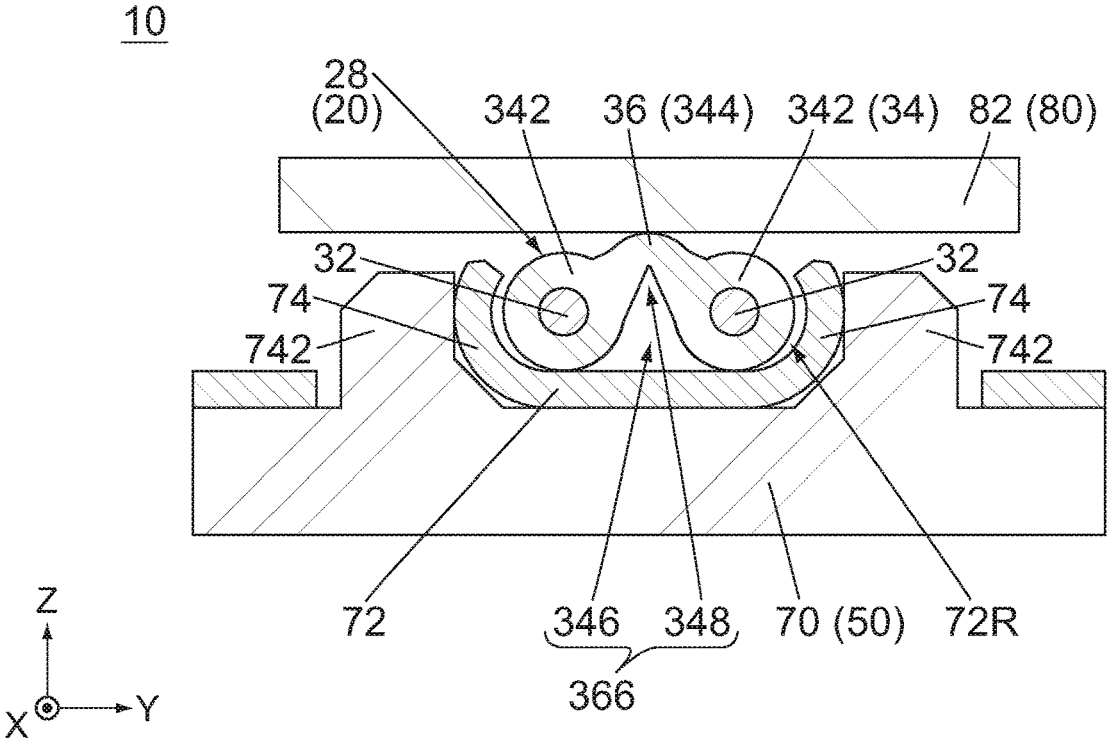
FIG. 12 is an end view showing the connection structure of FIG. 8, wherein the connection structure is under a state where the attachment step is performed.

Referring to FIGS. 11 to 13 in the next step, or in the attachment step (see FIG. 7), the pressing members 80 are attached to the base portion 70 as previously described. Thus, the forming method of the present embodiment comprises attaching the pressing member 80 to the base portion 70 to sandwich and press the pressed section 28 between the pressing member 80 and the catch portion 72 in the Z-direction, the sandwiched pressed section 28 being elastically deformed so that the two wires 32 of the pressed section 28 are away from each other in the Y-direction.

Referring to FIG. 11, in the attachment step (see FIG. 7), the ridge 344 of the pressed section 28 may be pressed toward the catch portion 72. Instead, referring to FIG. 14, in the attachment step, the two coverings 342 of the pressed section 28 may be pressed toward the catch portion 72.

Referring to FIG. 5, when the attachment step is ended, the distance DP between the two wires 32 of the pressed section 28 is longer than the distance DR between the two wires 32 of the held section 22 in the Y-direction. Referring to FIG. 3, when the attachment step is ended, each of the wires 32 is located at a position same as that of the corresponding pad 76 in the Y-direction. In detail, each of the wires 32 faces the corresponding pad 76 in the Z-direction or is in contact with the corresponding pad 76. Referring to FIG. 13, when the base portion 70 is provided with the side portions 74, at least one of the coverings 342 of the pressed section 28 is in contact with the corresponding side portion 74.

Referring to FIG. 3, in the next step, or in the connection step (see FIG. 7), each of the exposed portions 322 is fixed on and connected to the corresponding pad 76 via soldering, etc. As a result, each of the wires 32 is electrically connected with the corresponding terminal (not shown) of the connector 60 via the corresponding pad 76. Thus, the forming method of the present embodiment comprises connecting each of the exposed portions 322 to the corresponding pad 76 after the attaching.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connection structure comprising a cable and a connection object, wherein:

the cable includes two wires and an insulation body which covers and binds the two wires;

the insulation body includes two coverings;

the coverings cover the wires, respectively;

the connection object comprises a base portion and a pressing member;

the base portion has an attachment surface, a catch portion, two pads and a cable-holding portion;

the pads correspond to the wires, respectively;

the catch portion is provided on the attachment surface;

each of the pads is provided on the attachment surface and is located forward of the catch portion in a front-rear direction;

the cable-holding portion is located rearward of the catch portion;

the pressing member is attached to the base portion and is located forward of the cable-holding portion;

the cable has a held section and a pressed section;

the held section is held by the cable-holding portion;

the insulation body of the held section includes a ridge and is formed with a partition groove;

the ridge and the partition groove are located between the two coverings in a lateral direction perpendicular to the front-rear direction and are located at positions opposite to each other in an upper-lower direction perpendicular to both the front-rear direction and the lateral direction;

the ridge projects along a projecting direction directed upward or downward;

the partition groove is depressed along the projecting direction;

the pressed section is sandwiched and pressed between the pressing member and the catch portion in the upper-lower direction;

the insulation body of the pressed section includes a coupling strip;

the coupling strip couples the two coverings to each other in the lateral direction;

the coupling strip includes a middle ridge and is formed with a middle groove;

the middle ridge and the middle groove are located at positions opposite to each other in the upper-lower direction;

the middle ridge projects along the projecting direction;

the middle groove is depressed along the projecting direction;

the middle ridge of the pressed section is in contact with one of the pressing member and the catch portion, and the two coverings of the pressed section are in contact with at least a remaining one of the pressing member and the catch portion;

each of the wires has an exposed portion exposed from the covering;

each of the exposed portions is connected to a corresponding one of the pads; and in the lateral direction, a distance between the two wires of the pressed section is longer than another distance between the two wires of the held section.

2. The connection structure as recited in claim 1, wherein:

the base portion has two side portions;

the side portions correspond to the coverings, respectively;

the catch portion is located between the two side portions in the lateral direction;

each of the side portions extends to be away from the attachment surface in the upper-lower direction;

the pressed section is located between the two side portions in the lateral direction; and at least one of the coverings of the pressed section is in contact with a corresponding one of the side portions.

3. The connection structure as recited in claim 1, wherein:

one of the catch portion and the pressing member is provided with a projection; and the projection is located between the two coverings of the pressed section in the lateral direction.

4. The connection structure as recited in claim 1, wherein the middle ridge projects to be away from the catch portion in the upper-lower direction and is in contact with the pressing member.

5. The connection structure as recited in claim 1, wherein the middle ridge projects toward the catch portion in the upper-lower direction and is in contact with the catch portion.

6. The connection structure as recited in claim 1, wherein the held section has a cable cross-section perpendicular to the front-rear direction, in which the partition groove is located in only one of two areas vertically divided by an imaginary straight line that passes center points of the two wires.

7. The connection structure as recited in claim 1, wherein the two coverings of the pressed section are sandwiched and pressed between the pressing member and the catch portion in the upper-lower direction.

8. A forming method of a connection structure, the connection structure comprising a cable and a connection object, and the forming method comprising:

preparing the cable, the cable including two wires and an insulation body which covers and binds the two wires, the insulation body including two coverings and a ridge and being formed with a partition groove, the coverings covering the wires, respectively, the ridge and the partition groove being located between the two coverings in a lateral direction perpendicular to a predetermined direction along which the cable extends and being located at positions opposite to each other in an upper-lower direction perpendicular to both the predetermined direction and the lateral direction, the ridge projecting along a projecting direction directed upward or downward, and the partition groove being depressed along the projecting direction;

preparing the connection object, the connection object comprising a base portion and a pressing member, the base portion having an attachment surface, a catch portion, two pads, and a cable-holding portion, the pads corresponding to the wires, respectively, the catch portion being provided on the attachment surface, each of the pads being provided on the attachment surface and being located forward of the catch portion in a front-rear direction perpendicular to both the lateral direction and the upper-lower direction, and the cable-holding portion being located rearward of the catch portion;

forming an exposed portion of each of the wires and forming a pressed section of the cable, each of the exposed portions being exposed from the covering, the pressed section having an incision extending along the front-rear direction, and the incision being formed in a part of a wall of the partition groove located rearward of the exposed portions;

arranging the cable, one of the ridge and the incision of the pressed section of the arranged cable facing the catch portion, the arranged cable having a held section which is located rearward of the pressed section and is held by the cable-holding portion, each of the exposed portions of the arranged cable being located, at least in part, at a same position as a position of a corresponding one of the pads in the front-rear direction; and attaching the pressing member to the base portion to sandwich and press the pressed section between the pressing member and the catch portion in the upper-lower direction, the sandwiched pressed section being elastically deformed so that the two wires of the pressed section are away from each other in the lateral direction, wherein when the attaching is ended, a distance between the two wires of the pressed section is longer than another distance between the two wires of the held section in the lateral direction.

9. The forming method as recited in claim 8, further comprising connecting each of the exposed portions to a corresponding one of the pads after the attaching.

* * * * *